United States Patent [19]

Shenoha

[11] 4,015,525

[45] Apr. 5, 1977

[54] IMPRINTER AND ACTUATOR THEREFOR

[75] Inventor: James L. Shenoha, Lockport, Ill.

[73] Assignee: Norwood Marking & Equipment Company, Downers Grove, Ill.

[22] Filed: Apr. 26, 1976

[21] Appl. No.: 680,382

[52] U.S. Cl. ..... 101/333; 101/335

[51] Int. Cl.[2] ..... B41K 1/42

[58] Field of Search ..... 101/333, 334, 103, 104, 101/105, 41, 44

[56] References Cited

UNITED STATES PATENTS

| | | | |
|---|---|---|---|
| 3,599,566 | 8/1971 | Fish | 101/333 |
| 3,756,146 | 9/1973 | Norwood | 101/333 X |
| 3,797,390 | 3/1974 | Marozzi et al. | 101/333 |
| 3,804,016 | 4/1974 | Marozzi et al. | 101/333 |

*Primary Examiner*—Clifford D. Crowder

*Attorney, Agent, or Firm*—Hill, Gross, Simpson, Van Santen, Steadman, Chiara & Simpson

[57] ABSTRACT

An imprinting device for selectively marking a surface, for example a container, web, or the like, comprising a frame member having a power cylinder mounted thereon with a power arm ram reciprocatable in a first direction. A rigid non-sliding linkage connects the ram to a pivotable yoke member carried by the frame which in turn is pivotably connected to a type carrying member carrying a stamp head. The tupe carrying member is pivotable around a fixed point on the frame through a lost motion connection. The stamp has a vertical stamping movement and a horizontal inking movement. In the vertical movement the stamp projects above a plane of the frame while in the horizontal movement it is brought into contact with a disposable ink cartridge carried by the frame.

14 Claims, 15 Drawing Figures

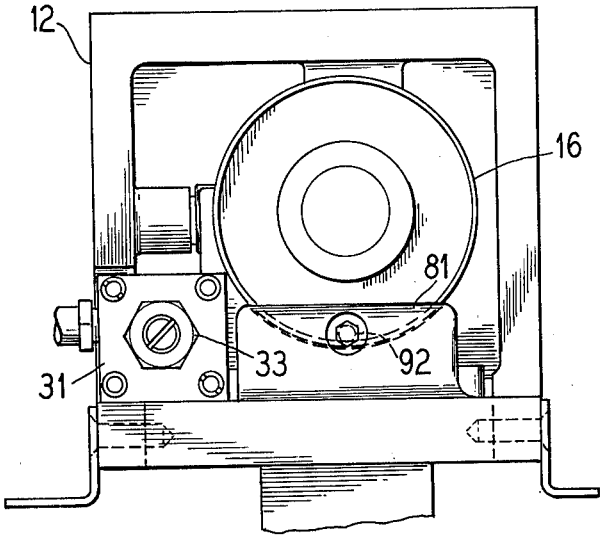
Fig. 4
Fig. 5
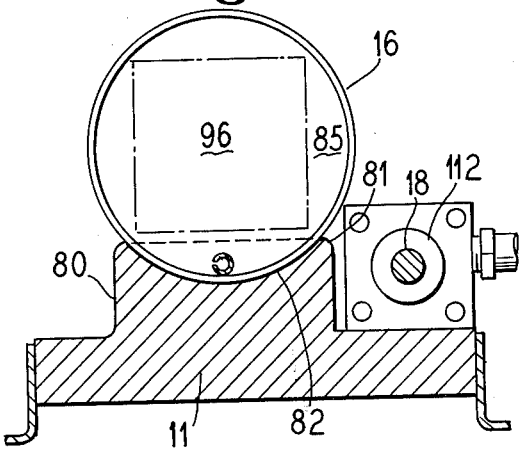
Fig. 7
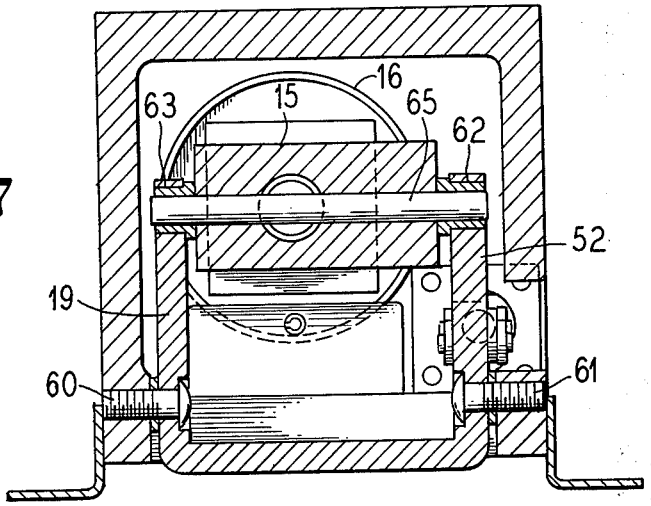
Fig. 6
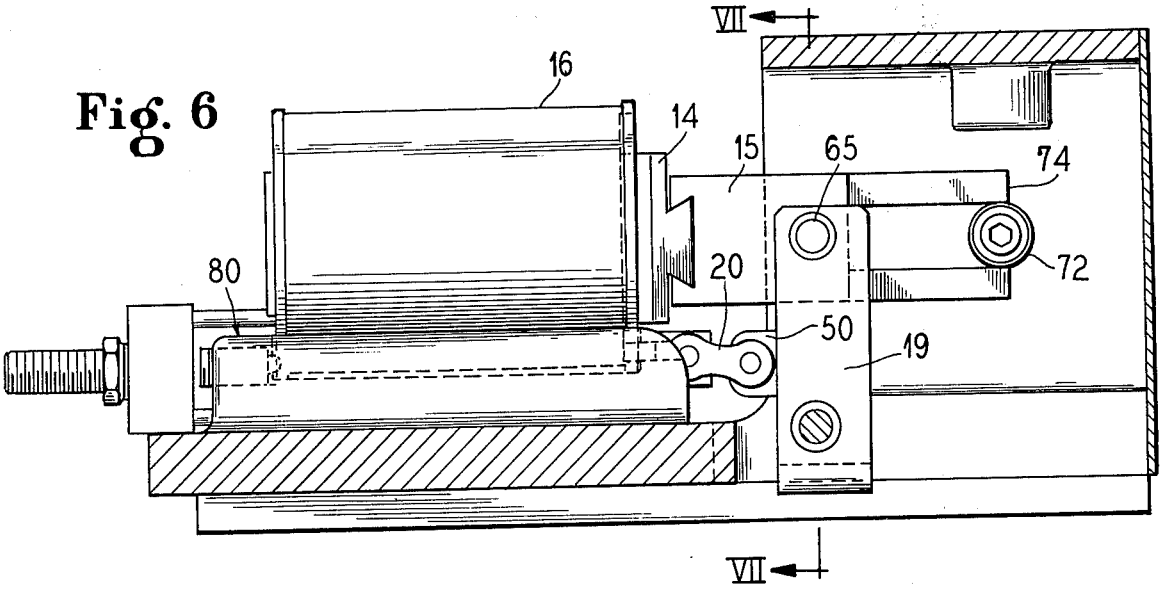

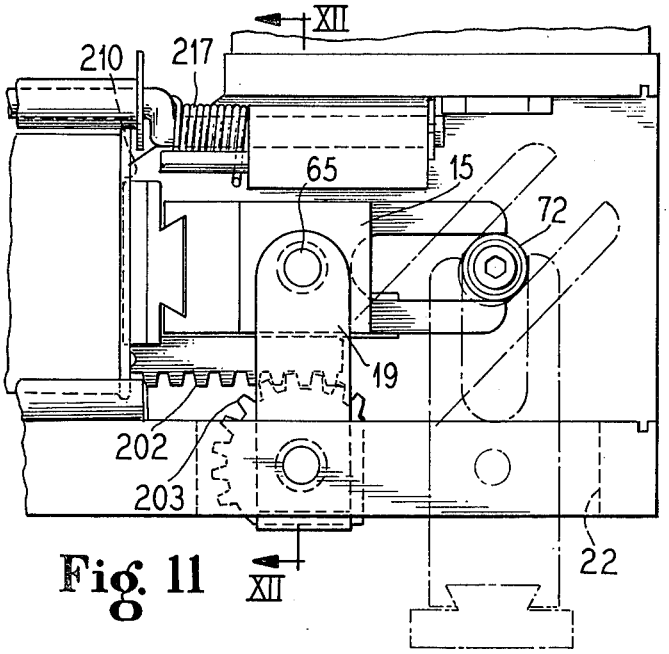
Fig. 11
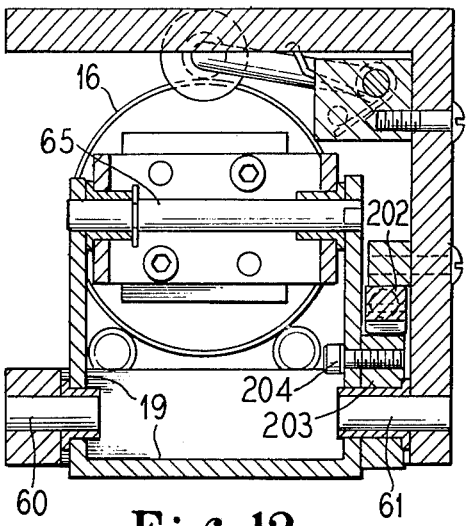
Fig. 12
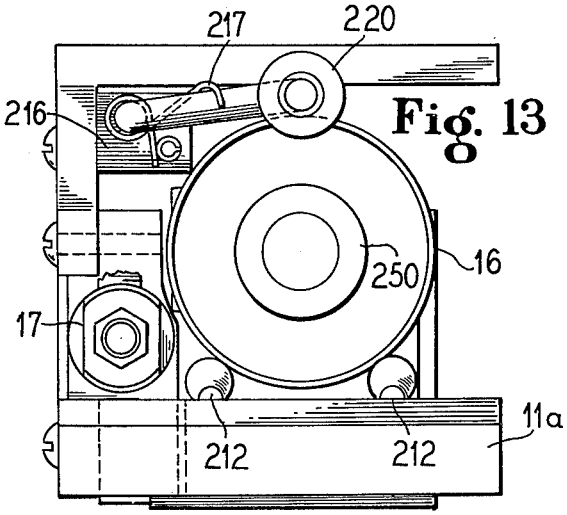
Fig. 13
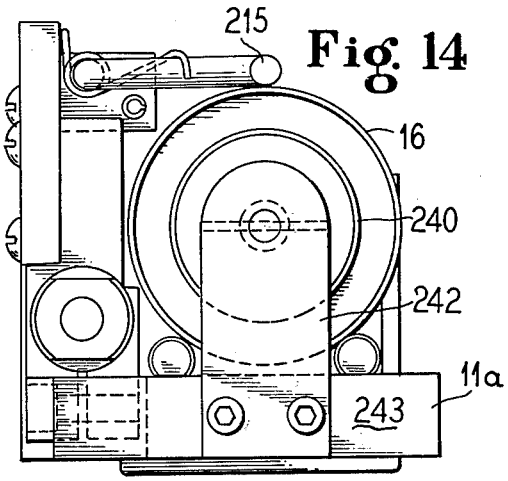
Fig. 14
Fig. 15
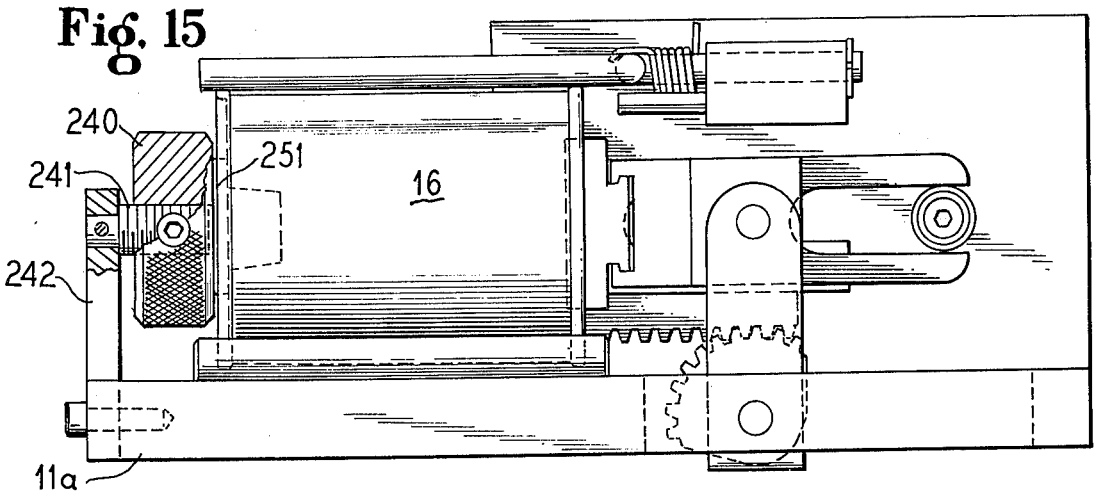

IMPRINTER AND ACTUATOR THEREFOR

BACKGROUND OF THE INVENTION

1. Field of the Invention

This invention relates to marking machinery and more particularly to a cyclic imprint marker.

2. Prior Art

Marking machines utilizing rubber or die cut stamps for imprint marking of items are known to the art. Many such markers are vertical action type, where the type bar carrier is cyclically moved vertically into imprinting contact with the item. The marking is normally done with an ink or die which is applied at the type face by abutment between it and an ink carrying member such as an ink pad. It is to be understood that when the terms vertical and horizontal are used herein, that these terms are only accurate in reference to one positioning of the imprinter frame and that it is foreseen that the imprinter frame could be positioned at a 90° angle from the one position thereby reversing the horizontal and vertical movements as those terms are used herein.

Since it is desired that the type bar or carrier move vertically at the time of imprint, and yet be brought into contact with an ink pad or the like between markings, positioning of the ink pad becomes a problem. While it has been frequently suggested to reverse the type carrier during vertical movements so that it undergoes a 180° cycle and then is brought into contact with an ink pad having a face spaced from and opposed to the item to be marked, such devices have an undesirably long movement of the type carrier. In addition, this requires complex linkages which are critically subject to wear. Further, such in-line systems require an unusually long frame assembly A more practical type of imprinter is described and shown in U.S. Pat. No. 3,756,146 to Eugene Norwood and assigned to the same assignee as this application. That patent, the teachings of which are herein incorporated by reference, shows an imprinter wherein the type carrier undergoes only a 90° movement from the imprint position to the inking position. In this construction, the face of the ink pad lies in a plane at right angles to the face of the article to be marked. The type carrying member is pivotable around a lost motion connection to the frame and is actuated by a first pivot member connected to a horizontally disposed power arm through a sliding cam.

While the above-described prior art construction represents a significant improvement over prior devices, in certain limited situations, the sliding cam drive may present disadvantages, particularly in requiring good lubrication. Further the sliding cam construction does not provide a highly efficient mechanical linkage. It would therefore be an advance in the art to provide such an imprinter device with a direct non-sliding linkage connection.

It would also be an advance in the art to provide such an imprinter with an easily removable and discardable inking cartridge.

SUMMARY OF THE INVENTION

My invention provides an imprinter device wherein the type bar or stamp is carried by a type carrying member pivotably attached to a first pivotable member and pivotable around a fixed housing carried pivot through a lost motion connection whereby the type carrying member undergoes a reverse arc movement to the movement of the first pivotable member. The first pivotable member is connected to the power ram through a non-sliding connection. In the preferred embodiment illustrated, the link connection consists of a double end pivoted link having one end pivoted to the power ram and an opposite end pivoted to the first pivotable member. In the preferred construction illustrated, the link is constructed of the manner of a drive chain link.

In another embodiment, the linkage is through a rack and pinion with the rack attached to and carried by the ram and the pinion attached to the first pivotable member at the pivot axis.

In both embodiments, the imprinter has a frame base with at least one upstanding side wall thereon. The double acting air cylinder is mounted on the base and controls the movement of a movable ram or power arm longitudinally of the base. The first pivotable member is pivoted to the frame and is preferably U-shaped having upstanding arms which terminate in pivotable connections to the type bar carrying member, the type bar carrying member being attached intermediate its ends with the type bar at one end and a lost motion connection to a fixed pivot carried by the frame side wall adjacent the other end. In this manner as the power arm moves the first pivotable member through the linkage connection, the first pivotable member will pivot through an arc from a position disposed substantially vertical to the frame bottom to a position disposed substantially horizontal thereto. This will cause the type carrying member to move from a position substantially horizontal to the frame bottom and spaced thereabove to a position substantially vertical to the frame bottom with the type bar extending through an opening in the frame bottom.

The frame bottom also carries a disposable inking cartridge which has an ink pad face positioned to be engaged by the type bar when the type bar is in its horizontal position. Adjusting means are provided to adjust the relative positioning of the ink cartridge face and the type bar so as to insure proper inking of the type face. In this manner, when the ram is in one position the type bar will be in contact with the inking cartridge and when the ram is in its opposite end position, the type bar will project through the base of the frame into a position where it can be brought into contact with an article to be marked.

It is therefore an object of this invention to provide an improved intermittent imprint marker.

It is another and more particular object of this invention to provide an intermittent inprint marker wherein the type bar carrying member is pivotably attached to a pivotable member driven by a moving ram, the type bar member also pivoting about a fixed pivot whereby it undergoes a reverse arc from the pivotable member with the type bar striking a surface to be imprinted at one end of movement of the ram and striking an inking device in a plane at right angles to the plane of the surface of the article to be marked at the other end of movement of the movable ram.

It is another and more specific object of this invention to provide an intermittent imprint marker having a type carrying member pivotably attached to a pivotable member driven through a linkage connection to a moving ram, the linkage connection being a rigid pivoting connection.

It is another more particular object of this invention to eliminate the slide cam drives of prior intermittent imprint markers and to replace the same with a pivotable linkage connection.

It is another specific object of this invention to provide an intermittent imprint marker wherein the type bar is carried by a type carrying member pivotable around a fixed pivot point on a housing by means of a lost motion connection therewith, the type carrying member being pivotably carried by a first pivoting member which is driven by a reciprocatively movable cam controlled by a double acting air cylinder, the linkage between the ram and the first pivotable member being a pivoting rigid linkage, and the marker being equipped with a disposable inking cartridge having an inking face contacted by the type bar at an inking position at one end of the movement of the ram with the type bar being rotated substantially 90° from the inking position to a marking position at the other end of movement of the ram and with means being provided to adjust the contact of the type bar with the cartridge inking face.

Other objects, features and advantages of the invention will be readily apparent from the following description of a preferred embodiment thereof, taken in conjunction with the accompanying drawings, although variations and modification may be effected without departing from the spirit and scope of the novel concepts of the disclosure, and in which:

BRIEF DESCRIPTION OF THE DRAWINGS

FIG. 4 is an end plan view of the imprint marker taken along the lines IV—IV of FIG. 3.

FIG. 5 is a transverse cross-sectional view of the imprint marker taken along the lines V—V of FIG. 3.

FIG. 6 is a view similar to FIG. 3 showing the imprint marker in its inking position.

FIG. 7 is a transverse cross-sectional view taken along the lines VII—VII of FIG. 6.

FIG. 11 is a fragmentary diagrammatic view of the embodiment of FIGS. 8 through 10 illustrating movement of the type carrying member.

FIG. 12 is a transverse cross-sectional view taken along the lines XII—XII of FIG. 11.

FIG. 13 is an end plan view taken along the lines XIII—XIII of FIG. 10.

FIG. 14 is a view similar to FIG. 13 illustrating a modification of the imprinter thereof.

FIG. 15 is a side plan view of the embodiment of FIG. 14.

DESCRIPTION OF THE PREFERRED EMBODIMENTS

Figure 1:
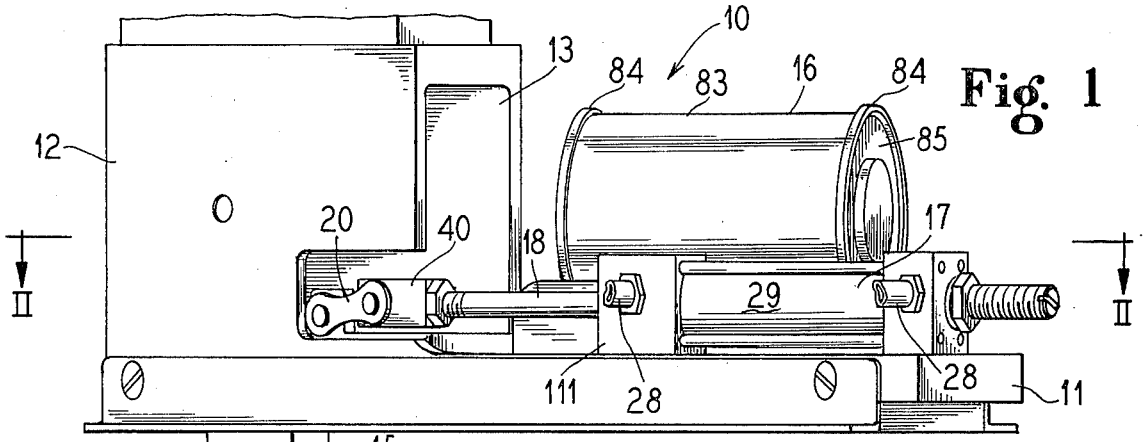
FIG. 1 is a perspective view of an imprint marker according to this invention.
Figure 2:
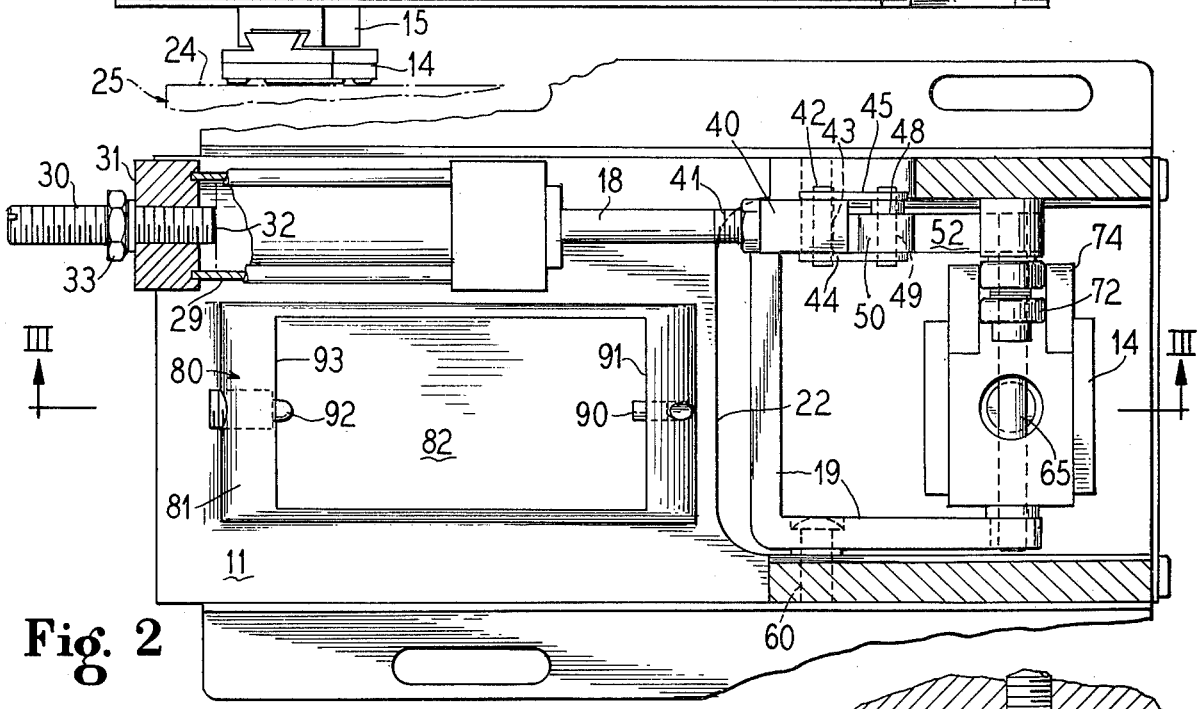
FIG. 2 is a top view, partially in section, taken along lines II—II of FIG. 1.

An intermittent imprint marker 10 is illustrated generally in FIG. 1. The marker consists of a frame having a base or bottom 11, upstanding side walls 12 and 13, a type bar 14 carried by a type bar carrying member 15, an inking cartridge 16, an air cylinder 17 operating a movable ram or power arm 18 and a linkage connection 20 between the power arm 18 and a first pivotable member 19 (shown in FIG. 2).

The frame bottom 11 has an opening 22 therethrough which the type carrying member 15 and type bar 14 may project to be brought into abutment with a surface 24 of an article to be marked 25.

The air or the other hydraulic cylinder 17 is of the double acting variety having a pressure fluid port 28 at either end of the cylinder 29, the cylinder receiving a piston which is connected to the ram 18. In order to allow adjustment of the final stop position of the type bar 14, the air cylinder is provided with an adjusting bolt 30 through the end face 31 which provides an abutment 32 internally of the cylinder 29 for contact by the piston. A lock nut 33 serves to keep the bolt 30 in place.

The ram 18 terminates in a block member 40 which is adjustably positioned on the ram by means of a threaded connection 41. The block member 40 has a pivot pin 42 received in a bore 43 therethrough having portions extending on either side of the block 40 and received in openings in link members 44 and 45. The pivot pin 42 may be rivet headed at both ends to be firmly attached to the link members 44 and 45. Other ends of the link members are attached to a pivot pin 48 in a similar manner, the pivot pin 48 also being rivet headed if desired. The pivot pin 48 extends through a bore 49 in a projection 50 on one leg 52 of a U-shaped first pivotable member 19. The U-shaped first pivotable member is pivotably attached to the frame as at 60 and 61, best illustrated in FIG. 7. Thus as the ram 18 reciprocates in and out of the air cylinder it will cause the U-shaped first pivotable member to pivot around the pivot points 60 and 61.

The free ends 62 and 63 of the legs of the U-shaped first pivotable member receive a pivot axle 65 fixed therein. The pivot axle 65 extends through and is connected to a central portion of the type bar carrying member 15. Thus as the first pivotable member 19 is moved, it will carry with it the type carrying member 15.

The type carrying member has the type bar 14 attached at one end 70 thereof and receives a fixed pivot 72 in a channel 73 adjacent the other end 74 thereof. The channel 73 is considerably longer than the diameter of the fixed pivot 72 so that the type bar carrying member is both pivotable around and movable with respect to the fixed pivot 72. This type of connection is herein referred to as being a lost motion pivotable connection.

Due to the lost motion pivotable connection, as the type bar carrying member is moved through an arc by means of the pivotable rotation of the first pivotable member, the end 70 will move through a reverse arc as it is rotated around the pivot axis 65 due to the lost motion pivot connection 72–73.

Figure 3:
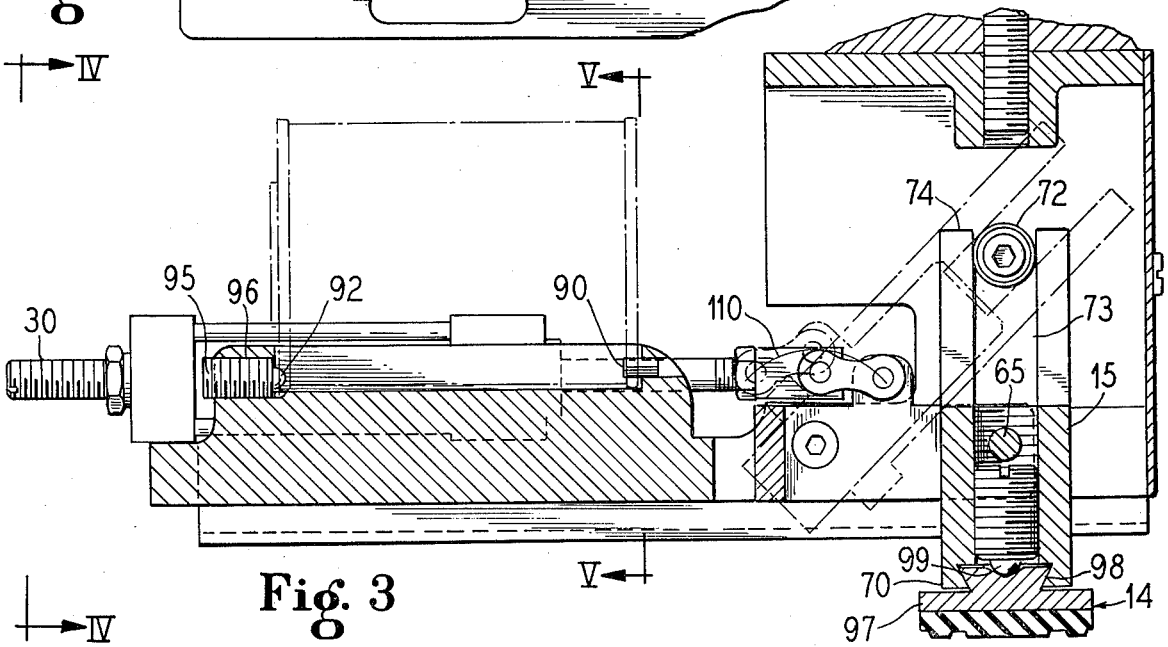
FIG. 3 is a longitudinal sectional view of the imprint marker taken along the lines III—III of FIG. 2.
Figure 8:
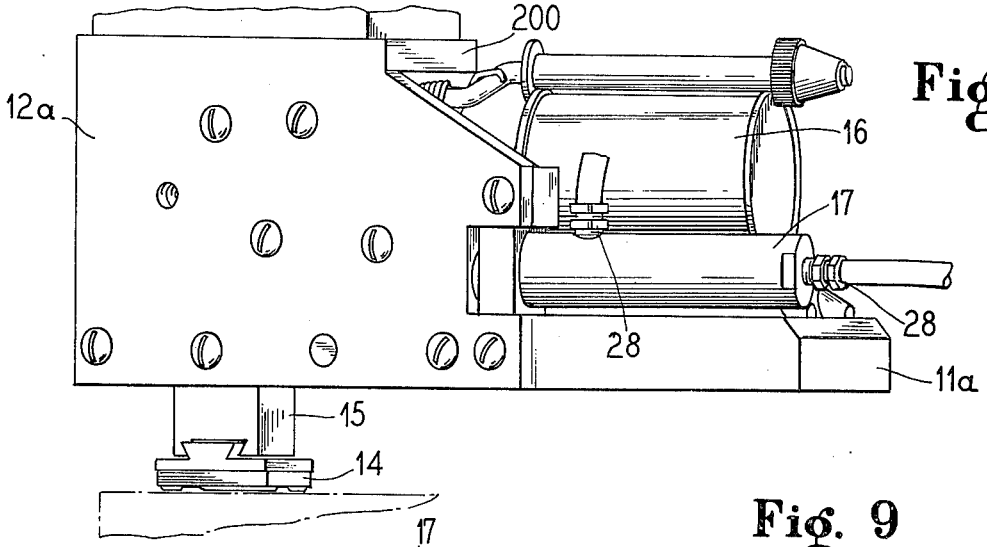
FIG. 8 is a view similar to FIG. 1 showing another embodiment of this invention.
Figure 9:
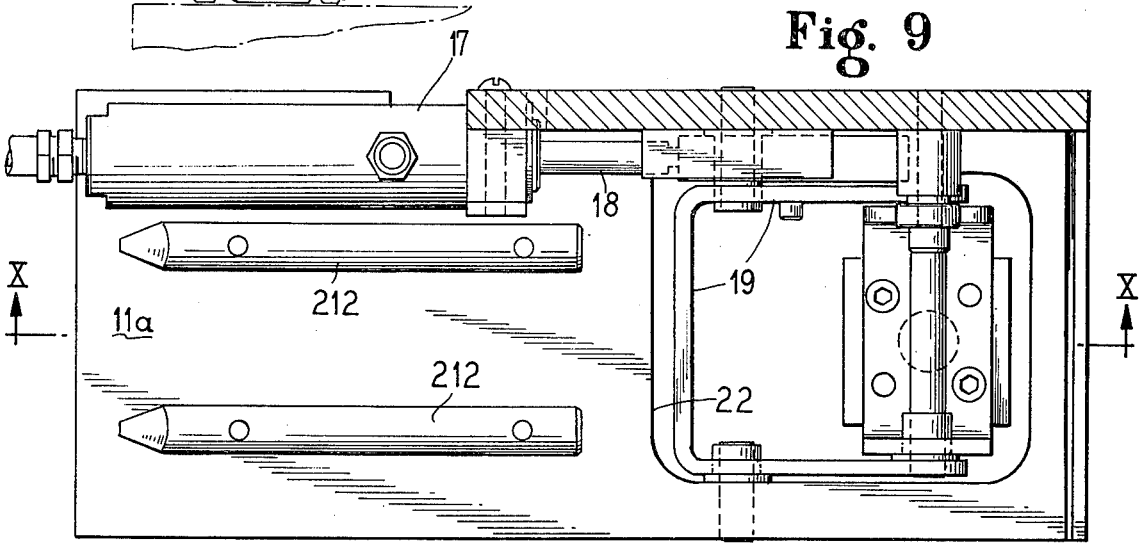
FIG. 9 is a top plan view partially in section of the embodiment of FIG. 8.
Figure 10:
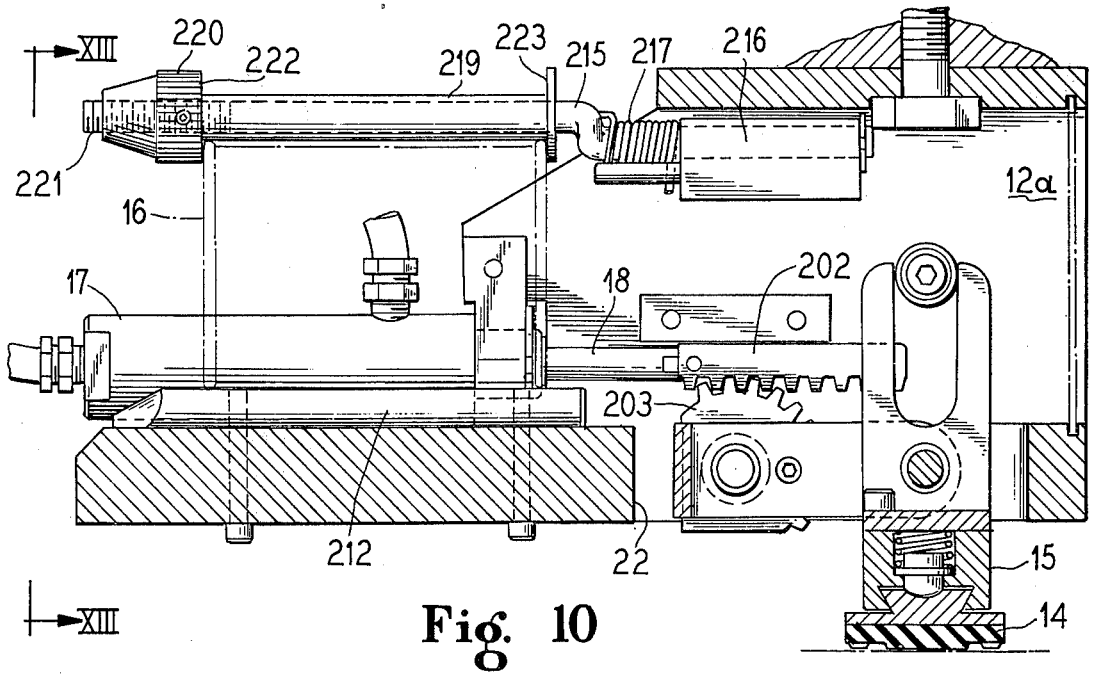
FIG. 10 is a longitudinal cross-section view taken along the lines X—X of FIG. 9.

The connection between the ram 18 and the first pivotable member is such that at one end movement of the ram, with the ram fully withdrawn into the cylinder, the legs of the first pivotable member will be positioned substantially vertically with respect to the base or bottom of the frame 11. At the other end of the ram movement, the legs will lie substantially parallel to or horizontal with respect to the frame bottom. During this movement, the type carrying member will be moved from a position, illustrated in FIG. 6, wherein the type carrying member lies generally horizontal with respect to the frame bottom, and spaced vertically thereabove to a position where it lies generally vertical with respect thereto as illustrated in FIG. 3.

At either end of the movement of the ram, the arc of the movement of the type carrying member is such that the type face is moving in an almost straight line. Therefore the type face can abut both the face of the inking cartridge and the surface 24 of the article to be marked without undesired smearing.

In the embodiment illustrated, the frame base 11 has a raised pad 80 thereon having a top surface 81 grooved as at 82 in a center section thereof for receipt of a disposable inking cartridge 16.

Preferably, the cartridge is formed in the manner of a can having a central can body 83 with raised rims 84 at either end thereof and slightly recessed end faces 85. The groove 82 is dimensioned to closely receive the can and a pin member 90 extends into the groove from a front wall 91 thereof, the pin member being raised slightly above the bottom of the groove. The pin 90 projects into the groove 82 a distance equal to or less than the depth of the recess of the end face 85 whereby the pin will overlie the rim 84 with the rim inserted underneath the pin. A spring backed rounded pin 92 extends into the groove from a rear face 93 thereof. Preferably the spring backed rounded pin 92 is received in a threaded housing 95 in turn received in a threaded bore 96 through the end wall 93. This allows adjustment. In this manner, the disposable inking cartridge can merely be snapped into the groove after the front rim has been inserted under the pin 90.

The disposable inking cartridge has an end surface at a front thereof having an ink pad area 96 dimensioned to receive the type bar 14.

The type bar 14, as best illustrated in FIG. 3 has a backing member 97 which is dove-tailed into a slot 98 in the end 70 of the type bar carrying member 15 and which is held therein under the influence of a spring backed locking member 99, which has a rounded end face received in a dimple in the dove-tailed extension of the backing member 97. The spring may, in the embodiment illustrated, be entrapped by the pivot axis 65.

The use of the dove tail and the spring allows a loose fit between the backing member and the end 70 thereby giving some shock absorbing abilities to the connection between the type bar carrying member and the type bar.

Adjustment of projection of the type bar when in the imprinting position can be achieved by means of the threaded connection 41 of the block 40. Adjustment of the extent of projection of the type bar in the inking position can be achieved by means of adjustment of the abutment 32.

As is indicated by the arc line 110 shown in FIG. 3, and from a comparison of the position of the link connection 20 in FIG. 6, the inking position and in FIG. 1, the marking position, it can be seen that the link connection is preferably designed as a type of over-center connection whereby the pivot pin 48 in both end positions of movement of the ram lies below the pivot pin 42 but moves upwardly above the pivot pin 42 during movement of the ram, as illustrated at 110. The reason for this over-center movement of the link connection is to reduce bending stress on the ram 18. In order to maintain the ram's planar movement, the end 111 of the air cylinder from which the ram projects has a sturdy bushing 112 surrounding the ram 18.

FIGS. 8 through 13 illustrate another embodiment of the invention wherein the frame base 11A has a single upstanding side wall 12A and an overlying cantilever top 200. In this embodiment similar features have been given similar numbers.

As in the prior embodiment, the power arm or ram 18 of the air cylinder 17 is connected through a linkage to the first pivotable member 19. In this embodiment, the linkage consists of a rack 202 mounted on the end of the power arm 18 which engages a pinion gear 203 in driving association with the first pivotable member 19 at the pivot 61 thereof, the drive connection being made by means of an illustrated drive bolt 204. Again the type bar carrying member is pivotably attached to the first pivotable member through a pivot pin 65 and is itself pivotable around a fixed pivot 72 through a lost motion connection to engage either the inking pad face 210 of the disposable ink cylinder 16 or to project through the opening 22 and into engagement with a surface to be marked.

In this embodiment, the bottom or base of the frame 11A has a pair of upstanding spaced apart ribs 212 thereon forming a cradle for the disposable ink cartridge. A hold down arm 215 is pivotably mounted in a holder 216 attached to the side wall 12A. A coil spring 217 urges the hold down arm 215 into engagement with an upper portion of the disposable inking cartridge 16. A spool shaped elongated tubular member 219 is received on the hold down arm 215 and has a knurled knob 220 in threaded engagement with a free end 221 thereof. The distance between the increased diameter face 222 of the knurled knob and the opposed increased diameter face 223 of the other end of the spool 219 is substantially equal to the length of the disposable inking cartridge 16. In this manner positioning of the inking cartridge on the cradle 212 can be effecutated by rotation of the knurled knob 220 to move the spool 219 longitudinally of the hold arm. Thus, there is provided a complete adjustment of the degree of contact between the type bar 14 and the ink saturated pad closing the opening 96 of the disposable ink cartridge.

FIGS. 14 and 15 illustrate a further modification of the embodiment of FIGS. 8 through 13. In this embodiment, the hold down arm 215 is not provided with the spool 219. Adjustment of the positioning of the ink cartridge is by means of a movable abutment 240 threaded on a bolt extension 241 of an upstanding projection 242 which may be bolted on the end face 243 of the frame 11A.

In all of the embodiments illustrated, the disposable ink cartridge 16 is preferably formed of a standard tin can which is substantially filled with an ink absorbing material. Preferably the can can be sealed at its stamping face for shipment with a plastic lid and can therefore be provided by the manufacturer pre-inked for easy placement in the imprinter. Where it is desirable to allow slight reuse of the cartridge, the cartridge can be provided with an opening 250 in its end face opposite the inking opening 96 which opening 250 can be closed by a stopper 251 which is removable to allow reinking of the material interior of the cartridge.

As can be seen from above, my invention provides an imprint marker wherein an imprinting type head is carried by a type bar carrying member pivotably carried by the first pivotable member which is acted upon by a linearly moving reciprocatable power arm. The connection between the first pivotable member and the power arm is by means of a rigid non-sliding connection. In one embodiment the connection is a double pivot link pivotably attached to the power arm at one end and to the first pivotable member at another end. In another embodiment the connection is by means of a rack and pinion. The imprint marker is designed to be used with a disposable inking cartridge and means are provided to adjust the relative positioning of the inking cartridge and the type bar to assure firm inking contact when the type bar is in an inking position at one end of the movement of the ram. The type bar carrying member pivots around a fixed pivot through a lost motion connection whereby the type head undergoes a 90° arcuate movement from the inking position to an imprinting position.

Although the teachings of my invention have herein been discussed with reference to specific theories and embodiments, it is to be understood that these are by way of illustration only and that others may wish to utilize my invention in different designs or applications.

I claim as my invention:

1. An imprint marker having a frame member, a stationary power cylinder carried by the frame member having a projectable power ram reciprocatable in a first longitudinal plane only, a type bar carrying member having a first end adapted to carry a type bar, a first pivotable member pivotably attached to the frame through a first pivot axis at a right angle to the projection of the power ram, the type bar carrying member pivotably attached to the first pivotable member at a moving second pivot axis parallel to the first pivot axis and spaced therefrom, the second pivot axis positioned intermediate first and second ends of the type bar carrying member, a second end portion of the type bar carrying member pivotable around a frame carried fixed pivot having a third pivot axis parallel to the first and second pivot axes, the connection between the second end portion and the fixed pivot being a lost motion connection, the improvement of a rigid force transmitting connection between the ram and the first pivoting member, said connection having portions thereof pivotable with respect to the ram and frame.

2. An intermittent imprint marker comprising: an elongated frame base, an air cylinder attached to said frame base having a ram disposed for movement only parallel to said frame base, said ram pivotably attached to a pivotable connection member, a first pivotable member attached to said housing, said first pivotable member pivotable through an arc, the arc lying in a plane parallel to the movement of the ram, said first pivotable member having a projection extending therefrom, said first pivotable member pivotably attached to said connection member at said projection, whereby movement of said ram imparts movement to the said first pivotable member through the said pivotable connection, and a type bar carrying member being mounted for pivotable movement on said first pivotable member and being attached to the housing by a pivotal, lost motion connection so that as the first pivotable member is pivoted by the ram, the type bar carrying member pivots relative to both the housing and the first pivotable member.

3. The marker of claim 2 wherein the pivotable connection is a link connection including at least one rigid link member having apertures therethrough adjacent opposite ends thereof, one of said apertures receiving a first pivot pin attached to said ram, the other of said apertures receiving a second pivot pin attached to said projection.

4. The imprint marker of claim 3 wherein the type carrying member has an inking position and a marking position with a type face carried by the type bar carrying member lying in a plane in one of said positions substantially at right angles to the plane in which it lies at in the other of said positions, the second pivot pin being parallel to the first pivot pin and lying below the first pivot pin when the type bar carrying member is in each of said positions and moving above the first pivot pin during movement of the type bar from one of said positions to the other of said positions.

5. An imprint marker comprising: a frame member with a base portion, an air cylinder mounted on said base portion having a movable ram power arm movable only longitudinally of said base member, an aperture through said base member, a first pivotable yoke member pivotably attached to said frame adjacent said aperture, a type bar carrying member pivotably attached to said yoke member, the pivotable attachment of the type bar carrying member to the yoke member being parallel and spaced from the pivotable attachment of the yoke member to the frame, the type bar carrying member being pivotably attached to the yoke member intermediate first and second ends of the type bar carrying member, a type bar on the first end of the type bar carrying member, a lost motion pivotable connection to a fixed pivot carried by said frame between portions of the second end of the type bar member lying on the opposite side of a pivot axis of the type bar carrying member from the type bar whereby pivoting of the yoke in one arc in a first direction will cause a reverse arc pivot of the type bar in the same direction, a linkage connection between the ram and the yoke for pivoting the yoke, movement of the ram from a position withdrawn in the air cylinder to an extended position projecting from the air cylinder moving the type bar from a position wherein the type bar carrying member lies substantially parallel to the base, the type face of the type bar lying substantially vertical with respect to the base to a position with the type bar carrying member projecting partially through the aperture substantially vertical to the base and the type face substantially parallel to the base, a disposable inking cartridge carried by said base having an exposed ink pad at one end thereof positioned relative to said base to be struck by the said type bar when the ram is in its withdrawn position, means for adjusting the relative positioning of the type bar to the ink pad when the ram is at its fully withdrawn position, and the connection between the ram and the yoke being a rigid pivotable connection.

6. The device of claim 5 wherein the connection is a double pivot link with one end of the link pivotably attached to the ram member and another end of the link pivotably attached to the yoke.

7. The device of claim 5 wherein the pivotable connection is a rack and pinion connection with a rack carried by the ram and a pinion gear carried by the yoke.

8. The device of claim 5 wherein snap in latch means are provided to retain the inking cartridge in position on the base, the cartridge having projecting peripheral rim end faces thereof.

9. The device of claim 5 wherein spring biased hold down means are provided to urge the inking cylinder against the base.

10. The device of claim 9 wherein the hold down includes spool means to adjust the position of the cylinder on the base.

11. An intermittent imprint marking device comprising a frame member having a base portion, a double acting air cylinder mounted on said base portion having a power ram projecting from an end thereof, a double pivot link assembly having one end thereof pivotably connected to a free end of said power arm projecting from said air cylinder, another end of said link pivotably connected to one arm of a substantially U-shaped first pivotable member which is pivotably attached to said frame adjacent a bight thereof, a second pivotable member pivotably connected to the first pivotable member adjacent free ends of arms of the U-shaped first pivotable member, the link connection to the first pivotable member lying intermediate the pivot attachment of the first pivotable member to the frame and the pivotable connection of the first pivotable member to the second pivotable member, the second pivotable member comprising an elongated member pivotably connected to the first pivotable member intermediate its ends, one of said ends carrying a type face, the other of said ends attached to the frame member through a lost motion pivotable connection, an ink cartridge receiving cradle on said frame base, an ink cartridge having end faces, a projecting peripheral rim extending beyond said end faces, said cradle having a resting surface for an outside of said ink cartridge and having projections spaced above said resting surface, said projection spaced from one another substantially the length of the ink cartridge with the projections projecting towards one another, one of said projections being spring loaded and movable away from the other of said projections, and the said projections indexable with the rims to snap lock said ink cartridge in position on said resting surface, one of said end faces of said ink cartridge comprising an ink stamp pad, said second pivotable member having an inking position and a marking position at substantially right angles to one another, the type face contacting the stamp pad at said inking position, and the inking and marking positions being at opposite end points of movement of the power ram into and out of the air cylinder.

12. The device of claim 11 wherein adjusting means are provided for adjusting the end points of movement of the power arm.

13. The device of claim 11 wherein one of said adjusting means constitutes an adjustable stop positioned interior of said air cylinder and positionable from exterior of the air cylinder.

14. The device of claim 13 wherein another of said adjustable means constitutes a threaded connection between an end portion of said power arm and a member carried by said power arm interposed between the pivotable ink and the power arm.

* * * * *

UNITED STATES PATENT OFFICE

CERTIFICATE OF CORRECTION

PATENT NO. : 4,015,525

DATED : April 5, 1977

INVENTOR(S) : James L. Shenoha

It is certified that error appears in the above-identified patent and that said Letters Patent are hereby corrected as shown below:

Abstract, line 8 "tupe" should read --type--.

Column 3, line 10 "cam" should read --ram--.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*